US005309064A

United States Patent [19]

Armini

[11] Patent Number: 5,309,064

[45] Date of Patent: May 3, 1994

[54] ION SOURCE GENERATOR AUXILIARY DEVICE

[76] Inventor: Anthony J. Armini, 19A Desmond Ave., Manchester, Mass. 01944

[21] Appl. No.: 34,250

[22] Filed: Mar. 22, 1993

[51] Int. Cl.[5] ..... H01J 7/24

[52] U.S. Cl. ..... 315/111.81; 315/111.81; 250/423 R

[58] Field of Search ..... 315/111.81; 250/423 R

[56] References Cited

U.S. PATENT DOCUMENTS

| | | | |
|---|---|---|---|
| 3,689,766 | 9/1972 | Freeman | 250/49.5 T |
| 3,774,026 | 11/1973 | Chavet | 250/49.5 ME |
| 4,446,403 | 5/1984 | Cuomo et al. | 315/111.81 |
| 4,739,170 | 4/1988 | Varga | 315/111.81 |
| 4,782,235 | 11/1988 | Lejeune et al. | 250/423 R |
| 4,845,364 | 7/1989 | Alexander et al. | 250/423 R |
| 4,870,284 | 9/1989 | Hashimoto et al. | 250/423 R |
| 4,952,843 | 8/1990 | Brown et al. | 250/423 R |
| 4,977,352 | 12/1990 | Williamson | 315/111.81 |
| 5,107,170 | 4/1992 | Ishikawa | 315/111.21 |

OTHER PUBLICATIONS

"Ion Implantation Techniques" by H. Ryssel and H. Glawischnig; Chapter 2 Ion Sources; Springer-Verlag 1982.

*Primary Examiner*—John T. Kwon

*Attorney, Agent, or Firm*—Don Halgren

[57] ABSTRACT

An ion source generating device having a main arc chamber and an auxiliary chamber attached to and in communication with the main chamber. The auxiliary chamber contains metal chips of barium, calcium or cerium to provide a reduction reaction of feed gas passing through the chamber and into the main chamber, in which ion beams are generated.

9 Claims, 3 Drawing Sheets

ION SOURCE GENERATOR AUXILIARY DEVICE

FIELD OF INVENTION

The present invention relates to ion sources utilized in ion beam generating equipment. More particularly, this invention relates to an arrangement for minimizing hazards from feed gases in ion source generators.

PRIOR ART

Ion sources in the semi-conductor industry are utilized to generate intense ion beams of phosphorous and arsenic, for doping silicon microcircuits.

U.S. Pat. No. 3,689,766 to Freeman shows an ion beam source utilized for implantation on an industrial production scale including means for automatically moving targets through the ion beam.

U.S. Pat. No. 3,774,026 to Chavet discloses an ion optical system for use with a magnetic prism so that its ion beam can converge in the vertical plane for effective focusing thereof.

An ion source generally consists of a plasma chamber from which a beam of positive ions can initially be extracted, and from which it then may be accelerated. The actual physics and technology of ion sources may be uncovered in D. Aiken, "Ion Sources", Chapter 2, Ion Implantation Techniques, H. Ryssel and H. Glawischnig, eds., Springer-Verlag, Berlin (1982), which is hereby incorporated by reference.

The structure of a typical ion source such as the known "Freeman" type, consists of a cylindrically shaped arc chamber which contains a tungsten filament, heatable by electric current, so as to thermionically emit electrons.

A gas may be introduced into the arc chamber at a pressure of about $10^{-3}$ Torr, which forms a plasma discharge between the arc chamber and the filament, which is biased at about minus 110 V. Positive ions from this plasma discharge are then electrostatically extracted from the plasma and are accelerated through an aperture in the extraction electrode wall.

In generating phosphorous and arsenic ion beams, phosphine ($PH_3$) and arsine ($AsH_3$), which are bottled gas feeds, are typically used because they yield the best control and give large currents of pure $^{31}P^+$ and $^{75}As^+$ beams, respectively.

Arsine and phosphine gases, however, are two of the most toxic and dangerous gases known. Arsine is particularly dangerous because it is invisible in air and is already above lethal concentrations before humans can detect its odor. Phosphine is only slightly less toxic.

Alternately, some ion sources use solid elemental phosphorous and arsenic which is vaporized in-situ in a heated chamber prior to introduction into the ion source. While this feed material yields large beam currents, the technique suffers from long heating times and many toxic cleanup and disposal problems.

Other gases have been used, i.e. the pentafluorides, $PF_5$ and $AsF_5$, which are convenient bottled gases, less toxic than arsine or phosphine, but they suffer poor $^{31}P^+$ and $^{75}As^+$ ion beam currents and, for this reason, they are seldom used in a production environment.

It is the principal object of the present invention to overcome some of the before mentioned disadvantages by providing an ion source for $^{31}P^+$ and $^{75}As^+$ which has high current output, and the convenience of a bottled gas feed source, but does not use the extremely toxic and dangerous phosphine and arsine gases.

BRIEF SUMMARY OF THE INVENTION

The present invention comprises an ion generating device having an arc chamber of the "Freeman" type which is in fluid communication with an adjacent auxiliary chamber. The arc chamber is generally cylindrically shaped, having walls made of graphite or molybdenum.

The arc chamber has an upper and lower end.

A discharge orifice is disposed in the wall of the arc chamber. The orifice is a longitudinally extending slot, having dimensions of about 60 mm by about 2 mm.

A tungsten filament is disposed between the upper and lower ends of the arc chamber, in alignment with and in proximity with the discharge orifice. The tungsten filament is insulatively disposed with respect to the upper and lower ends of the arc chamber.

The auxiliary chamber is attached to the side wall of the arc chamber, diametrically opposite the discharge orifice. The auxiliary chamber is of walled construction similar to the arc chamber, preferably of molybdenum or graphite.

An inlet gas line is in fluid communication with the distal end of the auxiliary chamber. The auxiliary chamber is adapted to contain metal chips of material such as calcium. The auxiliary chamber and the arc chamber are attached to one another and are themselves in fluid communication, through an interdisposed mesh screen therebetween.

The arc chamber is heated by a current through the tungsten filament. The arc chamber typically operates at a temperature in the range of 900° to 1000° C. The auxiliary chamber, due to this disposition with respect to the arc chamber, is heated to about 500°-700° C. by the waste heat therefrom. Alternately, the auxiliary chamber could have its own heat source.

A feed gas, which may be either phosphorous pentafluoride ($PF_5$) or arsenic pentafluoride ($AsF_5$) is driven through the inlet gas line and into the auxiliary chamber, through the hot calcium, and chemically reacts therewith. The feed gas is then reduced to either phosphorous or arsenic respectively, by the chemical reaction. The respective chemical reactions for the particular feed gases are:

| | | |
|---|---|---|
| $2PF_5 + 5Ca$ | 500° C. → or | $5CaF_2 + 2P\uparrow$ |
| $2AsF_5 + 5Ca$ | 500° C. → | $5CaF_2 + 2As\uparrow$ |

The $CaF_2$ which is formed in the auxiliary chamber, is the very stable and inert mineral fluorite. The free phosphorous or arsenic formed, which are gases at 500° C., are channeled into the arc chamber to form a pure elemental plasma with minimal contamination from fluoride molecular ions. The use of $AsF_5$ without the calcium containing auxiliary chamber forms a plasma, and ultimately a spectrum of its emitted beam which also contains undesired extraneous fluorine ions $F^+$ and $F_2^+$ and molecular ions $AsF^+$, $AsF_2^+$ and $AsF_3^+$.

The present invention, with the feed gas containing the desired target element arsenic or phosphorous (As or P), is reduced by the hot calcium chips in the auxiliary chamber causing the fluorine in the gas to precipitate out and remain in the auxiliary chamber as $CaF_2$, permitting the free arsenic As or phosphorous P to enter the arc chamber as a pure element.

BRIEF DESCRIPTION OF THE DRAWINGS

The objects and advantages of the present invention will become more apparent when viewed in conjunction with the following drawings in which.

DESCRIPTION OF THE PREFERRED EMBODIMENTS

Figure 1:
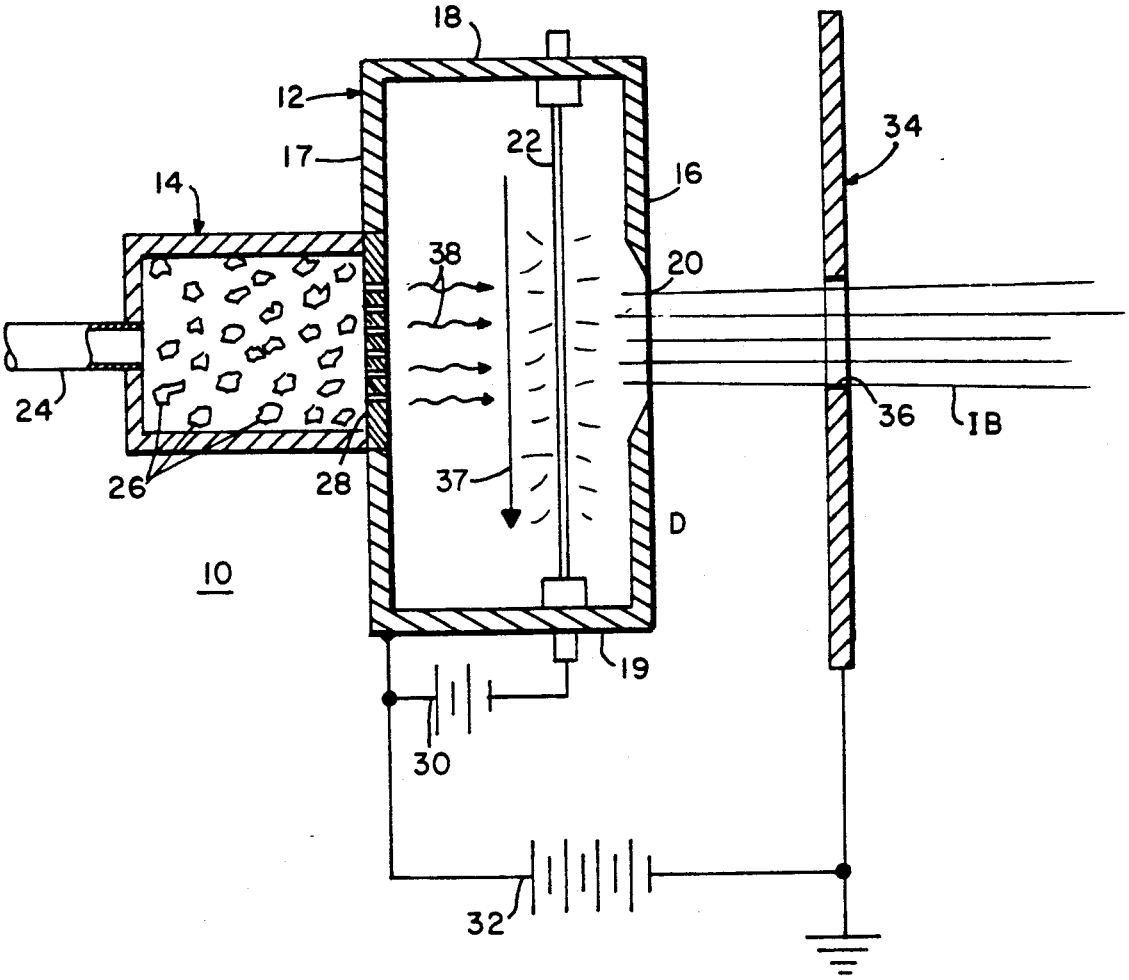
FIG. 1 is a cross-sectional view of an ion source generator constructed according to the principles of the present invention.

Referring now to the drawings in detail, and particularly to FIG. 1, there is shown an ion source 10 comprised of a generally cylindrically shaped arc chamber 12 in fluid communication with an auxiliary chamber 14. The arc chamber 12 has a front wall 16 and end walls 18 and 19, which are made of graphite or molybdenum.

A discharge orifice 20 is disposed through the front wall 16 of the arc chamber 12. The orifice 20 is a longitudinally extending slot, having a lengthwise dimension of about 30 to 60 mm, and a width of about 2 mm.

A tungsten filament 22 is insulatively disposed between the end walls 18 and 19, in longitudinal alignment with, and close proximity to the discharge orifice 20 in the front wall 16.

The auxiliary chamber 14 is attached to a rear wall 17 of the arc chamber 12, diametrically opposite the discharge orifice 20. The auxiliary chamber 14 has walls made of molybdenum or graphite, which are about 2 mm. thick, and has a volume of about 10 $cm^3$.

An inlet gas feed line 24 is in fluid communication with the distal end of the auxiliary chamber 14, as shown in FIG. 1. The inner volume of the auxiliary chamber 14 is about to hold about 20 to 50 grams of metal chips 26 such as aluminum, barium, calcium or cerium. It is noted that the metals could be of other forms than "chips"' for instance, a powder, or a sponge-like mass of (i.e.) calcium therein. The auxiliary chamber 14 and the arc chamber 12 are attached and are themselves in fluid communication, through a grate 28 or mesh screen in the rear wall 17, which prevents slippage of calcium chips 26 therepast.

The arc chamber 12 is heated to a temperature of about 900°-1000° C. by current flow through the tungsten filament 22 therein. The tungsten filament 22 is powered by a direct current source 30, typically about 3 to 5 volts D.C. at a current of 50 to 200 Amp. The auxiliary chamber 14 is heated to about 500°-700° C. by the waste heat from the arc chamber 12.

A feed gas such as phosphorous pentafluoride (PF:) or arsenic pentafluoride ($AsF_5$) passes from the feed line 24 into the auxiliary chamber 14 and arc chamber 12 at a pressure of about $10^{-3}$ Torr. The feed gases have their respective chemical reactions as follows:

| | | |
|---|---|---|
| $2\ PF_5 + 5Ca$ | 500° C. → or | $5CaF_2 + 2P\uparrow$ |
| $2AsF_5 + 5Ca$ | 500° C. → | $5CaF_2 + 2As\uparrow$ |

The $CaF_2$ which is formed during either reaction, is the very stable inert mineral fluorite. The free phosphorous or arsenic 38 formed, which are gases at 500° C., enter the arc chamber 12, through the mesh 28, as shown in FIG. 1.

The ion source 10 is operated by first forming a plasma in the arc chamber 12. The plasma is formed when all four constituents are present. The elemental gas 38, electron emission "D" from the hot filament 22, an arc voltage 30, between the filament 22 and the arc chamber 12, and a magnetic field 37 of typically 100 gauss parallel to the filament 22. Once a stable plasma of arsenic or phosphorous positive ions is formed, it is extruded through orifice 20 and accelerated through orifice 36 by an extraction electrode 34. This extraction voltage is provided by a direct current voltage source 32 which is typically 20,000 to 40,000 volts. The IB thus generated may then be utilized in any commercial ion implanter such as Eaton NV-3206 or a Varian 350D.

Figure 2:
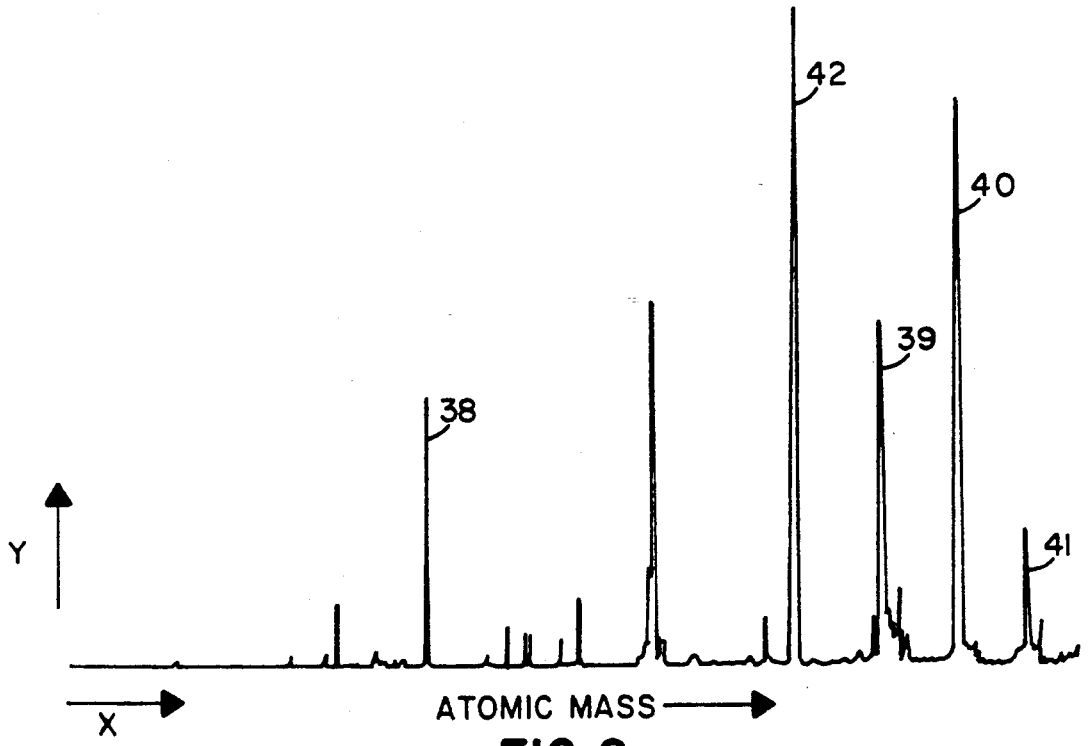
FIG. 2 is a spectrum produced by an ion source using $AsF_5$ feed gas without the calcium chip containing auxiliary chamber of the present invention.

FIG. 2 shows a "mass spectrum" obtained from a semiconductor ion implanter, such as a Eaton Corporation model NV3206, using $AsF_5$ as a feed gas without its passing through calcium chips in an auxiliary chamber. The plasma and subsequently the spectrum emitted in the beam contains fluorine ions $F^+$(38) as well as molecular ions $AsF^+$(39), $AsF_2^+$(40) and $AsF_3^+$(41). Thus, the desired ion beam of $^{75}As^+$(42) is diluted by extraneous ions to only 28% of the extracted beam content.

Figure 3:
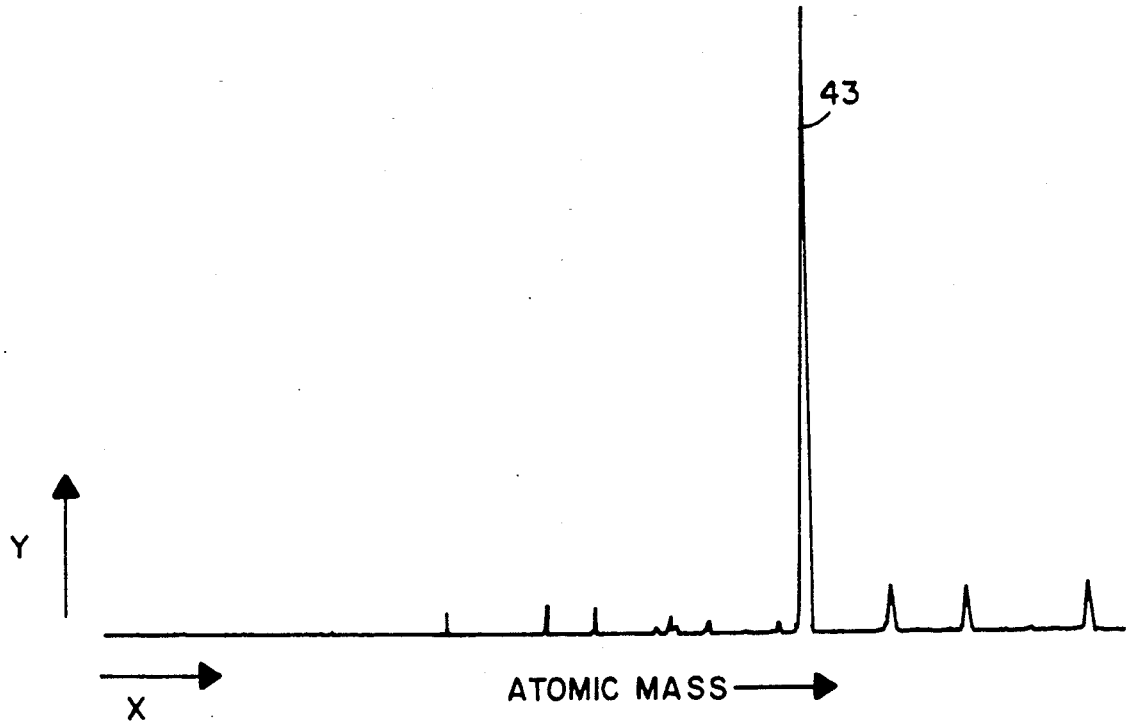
FIG. 3 is a spectrum produced by an ion source using $AsF_5$ feed gas with the calcium containing auxiliary chamber of the present invention.

FIG. 3 shows a corresponding "mass spectrum" obtained using $AsF_5$ feed gas when using an auxiliary chamber 14 of the present invention, filled with calcium chips and operating at optimum conditions according to the invention. The $^{75}As^+$ peak (43) is the most prominent and the extraneous fluorine containing peaks are greatly reduced. The $^{75}As^+$ fraction of the total extracted beam is greater than 80%. The gas containing the target element (As or P) is reduced by the calcium chips in the auxiliary chamber 14 causing the fluorine in the gas to precipitate out and remain in the auxiliary chamber 14 as $CaF_2$, allowing the free As or P to enter the arc chamber 12 as a pure element.

Figure 4:
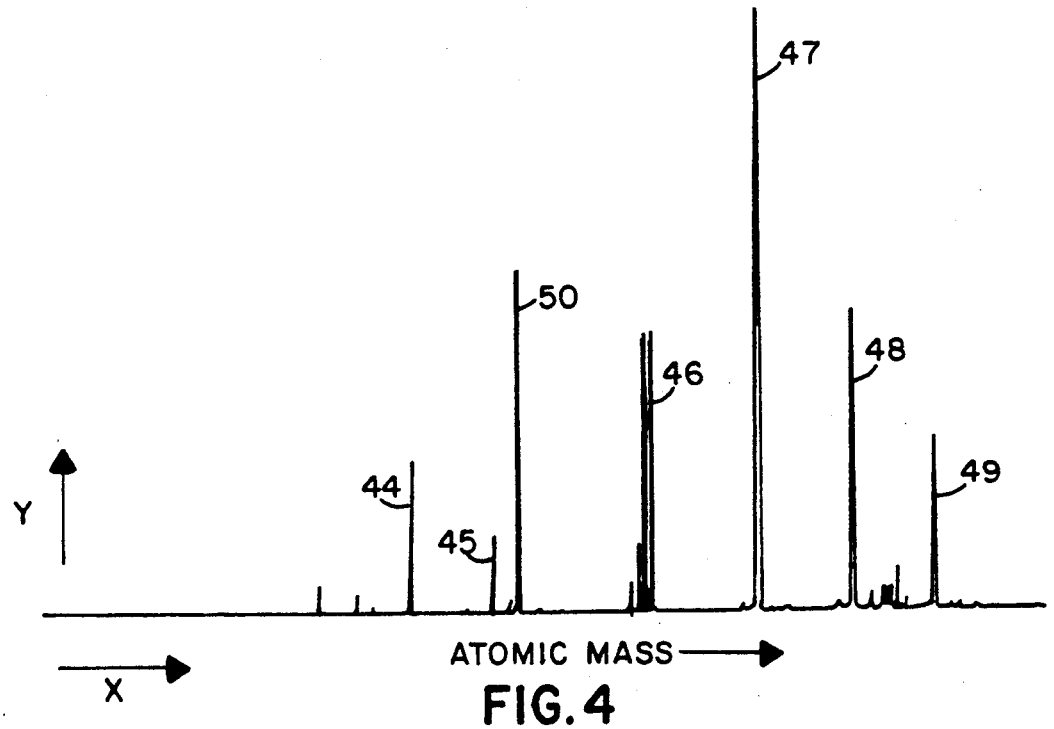
FIG. 4 is a spectrum produced by an ion source using $AsF_5$ feed gas with the calcium containing auxiliary chamber of the present invention.

FIG. 4 shows a "mass spectrum" obtained from a semiconductor ion implanter, such as an Eaton Corporation model NV3206, using $PF_5$ as a feed gas without its passing through calcium chips in an auxiliary chamber. The plasma and subsequently the spectrum emitted in the beam contains fluorine ions $F^+$ (44) and $F_2^+$ (45) as well as molecular ions $PF^+$ (46), and $PF_2^+$ (47) and $PF_3^+$ (48), and $PF_4^+$ (49). Thus, the desired ion beam of $^{31}P^+$ (50) is diluted by extraneous ions to only 17% of the extracted beam content.

Figure 5:
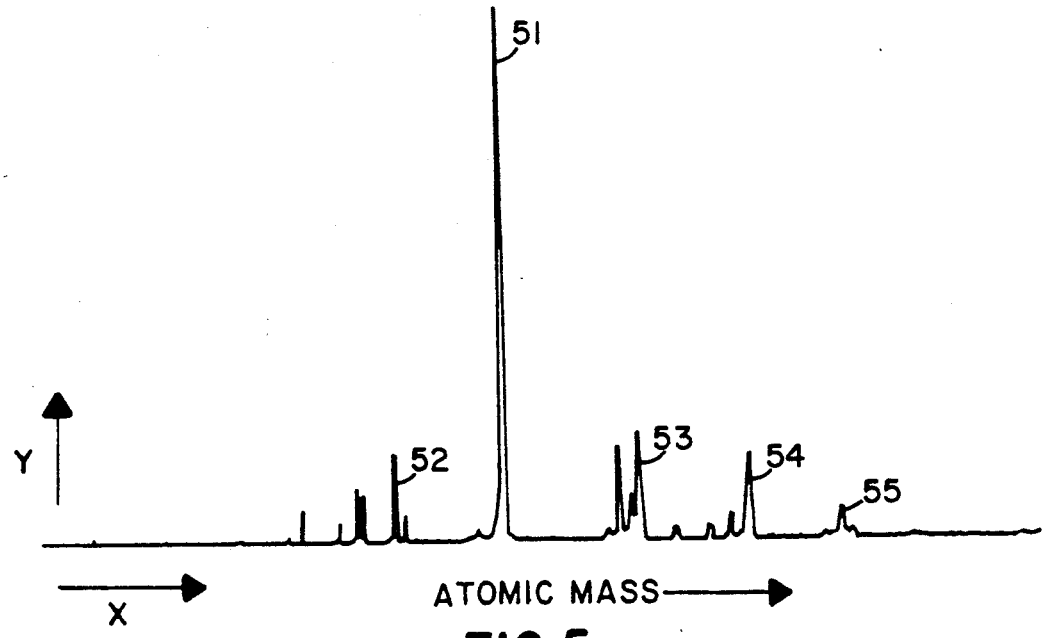
FIG. 5 is a spectrum produced by an ion source using $PF_5$ feed gas with the calcium containing auxiliary chamber of the present invention.

FIG. 5 shows a corresponding "mass spectrum" using $PF_5$ feed gas when using an auxiliary chamber 14 of the present invention, filled with calcium chips and operating at optimum conditions according to the invention. The $-P+$ peak (51) is the most prominent and the extraneous fluorine containing peaks (52, 53, 54, 55)

are greatly reduced. The $^{-}P^{+}$ fraction of the total extracted beam is greater than 53%.

In each of the FIGS. 2,3, 4 and 5, the vertical axis (y) represents the ion beam current, and the horizontal axis (x) represents increasing atomic mass units.

An example of a phosphorous ion beam generated utilizing the present invention in conjunction with an Eaton Corporation NV3206 ion implanter used the following parameters:

| | |
|---|---|
| Feed Gas: | $PF_5$ |
| Gas Inlet Pressure: | $10^{-3}$ Torr |
| Filament Voltage: | 3.5 volts |
| Filament Current: | 60 Amp |
| Arc Voltage: | 75 volts |
| Arc Current: | 0.5 Amp |
| Extration Voltage: | 20,000 volts |
| Calcium Volume: | 8 $cm^3$ |

These conditions produced a resulting ion beam current in the $^{31}P^{+}$ peak, of 500 microamp. The total mass spectrum obtained is shown in FIG. 5. The corresponding spectrum for $PF_5$ feed gas without using the invention is shown in FIG. 4.

In a second example, an arsenic ion beam was generated using the invention on an Eaton NV3206 ion implanter using the following parameters:

| | |
|---|---|
| Feed Gas: | $AsF_5$ |
| Gas Inlet Pressure: | $10^{-3}$ Torr |
| Filament Voltage: | 3.5 volts |
| Filament Current: | 60 Amp |
| Arc Voltage: | 75 volts |
| Arc Current: | 0.5 Amp |
| Extraction Voltage: | 20,000 volts |
| Calcium Volume: | 8 $cm^3$ |

These conditions produced a resulting ion beam current in the $^{75}As^{+}$ peak, of 600 microamp. The total mass spectrum of all the ion beams thus obtained is shown in FIG. 3.

Thus, what has been shown is a novel method to utilize safer and much less toxic feed gases in the generation of ion beams for ion implantation devices, utilizing an auxiliary chamber containing metal chips such as aluminum, barium, calcium or cerium as a reactant to reduce the $AsF_5$ or $PF_5$ feed gas passing therethrough and into the arc chamber, generating a more pure elemental plasma.

I claim:

1. An ion source for producing an ion beam from a feed gas comprising:

an arc chamber having an inlet orifice and an outlet orifice;

an auxiliary chamber in fluid communication with said arc chamber;

a feed gas input line into said auxiliary chamber;

a filament for generating electrons in said arc chamber, together with a power source for heating and biasing said filament; and a metal chip reactant contained in said auxiliary chamber which provides a reduction reaction of the feed gas passing therethrough.

2. An ion source as recited in claim 1, wherein said metal chip reactant is selected from the group consisting of aluminum, barium, calcium and cerium.

3. An ion source as recited in claim 2, wherein a feed gas is driven through said metal chips is selected from the group consisting of arsenic pentafluoride or phosphorous pentafluoride.

4. An ion source as recited in claim 3, wherein said filament heats said arc chamber to a temperature of about 900° C. to about 1000° C.

5. An ion source as recited in claim 3, wherein said auxiliary chamber containing said metal chips is heated to a temperature of about 500° C. to about 700° C.

6. An ion source as recited in claim 5, wherein said auxiliary chamber is heated by contact with said heated arc chamber.

7. A method of generating an ion beam from an arc chamber, comprising the steps of:

attaching an auxiliary chamber to a wall of the arc chamber, with an orifice providing fluid communication therebetween;

providing a reactant material of metal chips in said auxiliary chamber;

heating said arc chamber up to a temperature of about 900° C. to about 1000° C. with an energizable electron emitting filament thereacross:

passing a feed gas under pressure through said metal chips in said auxiliary chamber so as to form a stable solid fluoride compound therein;

emitting an ion beam from an exit orifice in said heated arc chamber.

8. The method of generating an ion beam as recited in claim 7, including:

selecting the reactant metal chips from the group consisting of aluminum, barium, calcium and cerium.

9. The method of generating an ion beam as recited in claim 8, including:

selecting the feed gas to be passed through said auxiliary chamber from the group consisting of arsenic pentafluoride and phosphorous pentafluoride.

* * * * *